US007802499B2

(12) United States Patent
Stephens

(10) Patent No.: US 7,802,499 B2
(45) Date of Patent: Sep. 28, 2010

(54) FASTENER DRIVER

(76) Inventor: John F. Stephens, 7097 W. Walker La., Ellettsville, IN (US) 47429

( * ) Notice: Subject to any disclaimer, the term of this patent is extended or adjusted under 35 U.S.C. 154(b) by 233 days.

(21) Appl. No.: 12/212,956

(22) Filed: Sep. 18, 2008

(65) Prior Publication Data

US 2010/0064859 A1 Mar. 18, 2010

(51) Int. Cl.
*B25B 13/02* (2006.01)
*B25B 13/06* (2006.01)

(52) U.S. Cl. ..... 81/124.2; 81/125

(58) Field of Classification Search ..... 81/124.2, 81/125, 121.1, 901; D8/29
See application file for complete search history.

(56) References Cited

U.S. PATENT DOCUMENTS

| | | | | |
|---|---|---|---|---|
| 2,231,323 | A | 2/1941 | Cawood | |
| 2,491,089 | A | 12/1949 | Cowden | |
| D173,939 | S | 2/1955 | Deliso | |
| 3,086,414 | A | 4/1963 | Nardi | |
| 3,151,512 | A | 10/1964 | Charczenko | |
| D274,881 | S | 7/1984 | Wilsey | |
| 4,823,650 | A | 4/1989 | Tuttle | |
| D379,420 | S | 5/1997 | Standlee et al. | |
| 5,697,268 | A | 12/1997 | Makovsky et al. | |
| 5,943,922 | A | 8/1999 | Rolfe | |
| D426,438 | S | 6/2000 | Ciok | |
| 6,294,719 | B1 | 9/2001 | Palecki et al. | |
| 6,382,053 | B1 | 5/2002 | Macor | |
| 6,626,068 | B2 * | 9/2003 | McKivigan | 81/124.2 |
| 6,701,807 | B1 | 3/2004 | Gammon | |
| 6,715,384 | B1 | 4/2004 | Kozak | |
| 6,729,210 | B2 | 5/2004 | Morris | |
| 7,181,999 | B1 * | 2/2007 | Skeels et al. | 81/124.2 |
| 2007/0012143 | A1 * | 1/2007 | Tracy | 81/124.2 |
| 2007/0039422 | A1 * | 2/2007 | Rogers | 81/124.2 |

* cited by examiner

*Primary Examiner*—David B Thomas
(74) *Attorney, Agent, or Firm*—Maginot, Moore & Beck

(57) ABSTRACT

A socket for driving two different types of fasteners in one embodiment includes a driving portion with an outer surface and a driving bore, a base portion, a plurality of lands extending along the driving bore and configured to drive a first type of fastener, and a cradle positioned within the driving bore and defining a driving surface for a second type of fastener, the driving surface curved within a first plane perpendicular to a longitudinal axis of the socket and curved within a second plane in which the longitudinal axis extends.

20 Claims, 3 Drawing Sheets

FASTENER DRIVER

FIELD OF THE INVENTION

The present disclosure relates generally to tools for driving fasteners and the like.

BACKGROUND

A wide variety of motorized and manually driven tools for driving fasteners are known in the art. Box wrenches, hex wrenches, screwdrivers, etc., and various motorized devices are employed across a broad spectrum of technical areas where fasteners are used. So called "socket" wrenches and various motorized socket-driving tools are widely used to provide a relatively rapid and convenient means of driving fasteners, fastener nuts and similar articles.

A conventional socket consists of a cylindrical body with an orifice configured to receive the article to be driven or a portion thereof. Such sockets also typically include an aperture or protrusion opposite the orifice used to couple the socket with a driving member for applying a torque to rotate the socket when a fastener or fastener nut is positioned therein. The specialized head shape of certain types of fasteners, however, such as eyebolts, hooks, T-bolts and the like, have required a differently configured socket to accommodate the different shapes of the fasteners.

One type of socket adapted for driving eyebolts and similar fasteners employs a slot configured to receive the head of an eyebolt or the like such that rotation of the socket forces rotation of the fastener which is used to drive the fastener into or out of a substrate. While such socket designs offer a measure of improvement over attempting to manually drive the fasteners into a work piece, when higher torque is applied to the sockets, the head of the fastener tends to slip out of the desired engagement with the driving socket. In particular, it is common during driving of eyebolts and the like for a driven fastener to slip to one side within the socket, thereby twisting or sliding into a position that is not aligned with the socket axis. When so positioned, rotation of the fastener is hindered and the fastener may become damaged, frustrating the user and slowing the operation.

What is needed therefore is a socket which can be used to drive different types of fasteners. A further need exists for a fastener that reduces the potential for slippage of a fastener within the socket as the fastener is being driven.

SUMMARY

In accordance with one embodiment a socket for driving two different types of fasteners in one embodiment includes a driving portion with an outer surface and a driving bore, a base portion, a plurality of lands extending along the driving bore and configured to drive a first type of fastener, and a cradle positioned within the driving bore and defining a driving surface for a second type of fastener, the driving surface curved within a first plane perpendicular to a longitudinal axis of the socket and curved within a second plane in which the longitudinal axis extends.

In accordance with another embodiment, a socket for driving at least two different types of fasteners includes a driving portion with an inner surface and an outer surface, a plurality of driving surfaces extending longitudinally along the inner surface of the driving portion for driving a first type of fastener, and a cradle extending inwardly from the outer surface along a continuously curved line for driving a second type of fastener.

In accordance with a further embodiment, a socket includes a driving portion including an outer side surface and a driving bore, a base portion defining a coupling bore, the coupling bore opening to the driving bore, a first plurality of driving surfaces extending longitudinally within the driving bore opposite to the side surface, each of the first plurality of driving surfaces positioned with respect to each of the other of the first plurality of driving surfaces to drive a first type of fastener, and a second plurality of driving surfaces, each of the second plurality of driving surfaces extending along a continuously curved line from the outer surface of the driving portion to the coupling bore.

DESCRIPTION

Figure 1:
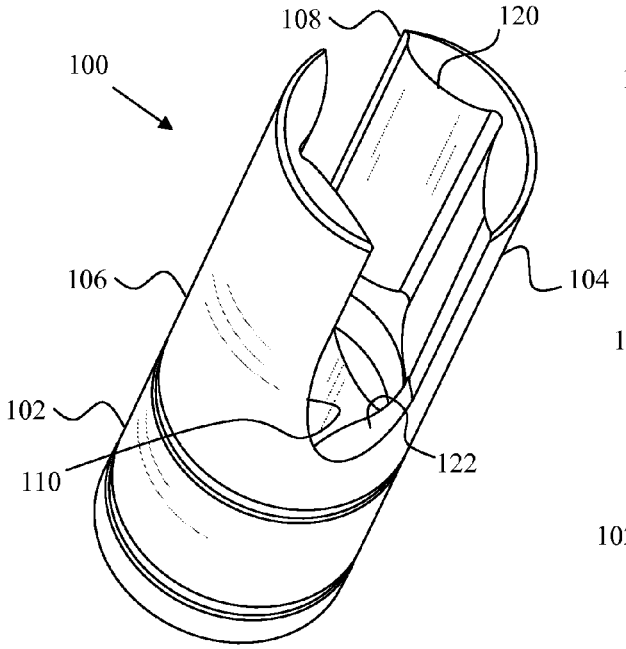
FIG. 1 depicts a perspective view of a socket including a plurality of longitudinally extending engagement surfaces and a cradle in accordance with principles of the present invention.
Figure 2:
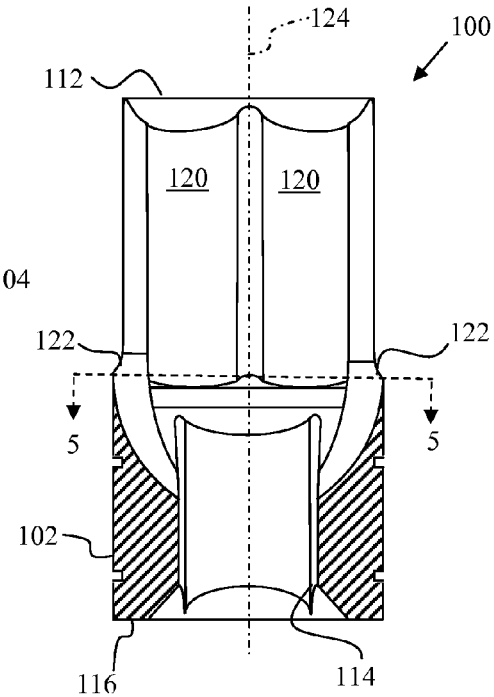
FIG. 2 depicts a cross sectional view of the socket of FIG. 1 showing the cradle curving inwardly from the outer surface of the socket to the driving bore of the socket.
Figure 3:
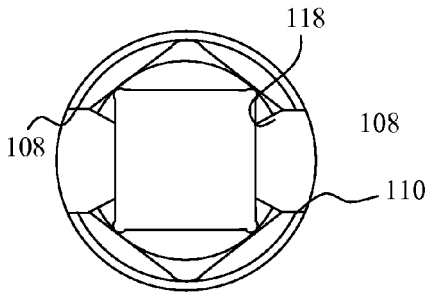
FIG. 3 depicts a top plan view of the socket of FIG. 1 showing the cradle meeting the outer surface of the socket as the slots in the outer wall.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 4:
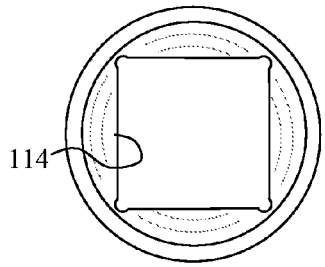
FIG. 4 depicts a bottom plan view of the socket of FIG. 1.

A socket 100 is shown in FIGS. 1-5. The socket 100 includes a base 102 and a driving portion 104. As viewed from the outer surface 106 of the socket 100, two slots 108 and 110 extend from a distal end portion 112 of the socket 100 along the driving portion 104 toward the base 102. A coupling bore 114 extends inwardly from a proximal end portion 116 as best seen in FIG. 4. The coupling bore 114 opens to a driving bore 118 which opens to the distal end portion 112. The driving bore 118 is defined by a plurality of lands 120 which extend inwardly from the distal end portion 112 and a cradle 122 which extends inwardly from the slots 108 and 110 to the coupling bore 114.

The socket 100 may be formed of a metallic material such as hardened steel, or other strong material. Forming of the socket 100 may be accomplished by casting, forging, machining or any other suitable process or combination of processes. By way of example, various features of the socket 100 may be formed during initial casting of the socket 100 while other features may be formed by grinding.

The coupling bore 114 in this embodiment is configured to mate with a complementary portion of a rotating tool such as a conventional socket wrench (not shown) or other rotating device. The rotating device may be manually rotated or rotated by a motor, air, or other motive force. The coupling bore 114 may include an orifice or a protrusion to facilitate mating with the rotating device.

The lands 120 are configured to engage objects with polyangular engagement surfaces such as bolt heads, nuts, and the like. To this end, the lands 120 in this embodiment are substantially planar surfaces which extend parallel to the longitudinal axis 124 of the socket 100. In other embodiments, the lands 120 may be curved and/or ridged. Additionally, more or fewer lands 120 may be provided in alternative sockets.

The slots 108 and 110 are positioned opposite to one another on the driving portion 104 to allow the socket 100 to be used to drive fasteners which include head portions that are wider than the diameter of the driving bore 118. The extent of the outer surface 106 which is interrupted by the slots 108 and 110, however, affects the strength of the driving portion 104. Thus, while additional slots may be provided in alternative embodiments so as to allow additional fastener types to be driven using a particular socket, still other embodiments forego the inclusion of slots so as to increase the strength of the socket.

Figure 5:
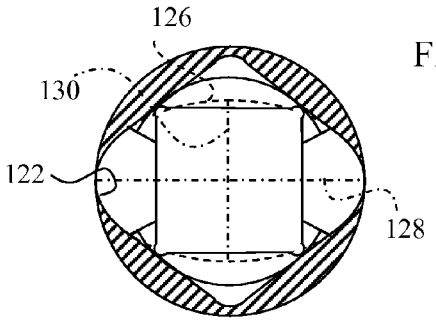
FIG. 5 depicts a cross sectional view taken along the line 5-5 of FIG. 2 in a plane perpendicular to the longitudinal axis of the socket of FIG. 1 showing a cradle curving inwardly from the outer surface of the socket in a plane perpendicular to the longitudinal axis of the socket.

The cradle 122 extends from the outer surface 106 to the coupling bore 114. The joints formed by the cradle 122 and the outer surface 106 and the coupling bore 114 may be rounded to reduce sharp edges. The cradle 122 is an arcuate surface which is symmetrically shaped about the longitudinal axis 124. As shown in FIG. 5, the cradle 122 in this embodiment is not spherical. Thus, when viewed in cross section in a plane perpendicular to the longitudinal axis 122 as in FIG. 5, the cradle 122 is defined by an ellipse 126 with a major axis 128 aligned with the slots 108 and 110 and a minor axis 130. In alternative embodiments, the relative dimensions of the major axis 128 and the minor axis 130 are varied. Additionally, while the cradle 122 is shown with a spherical cross section in FIG. 2, the curvature of the cradle 122 may be varied in this plane as well.

Figure 6:
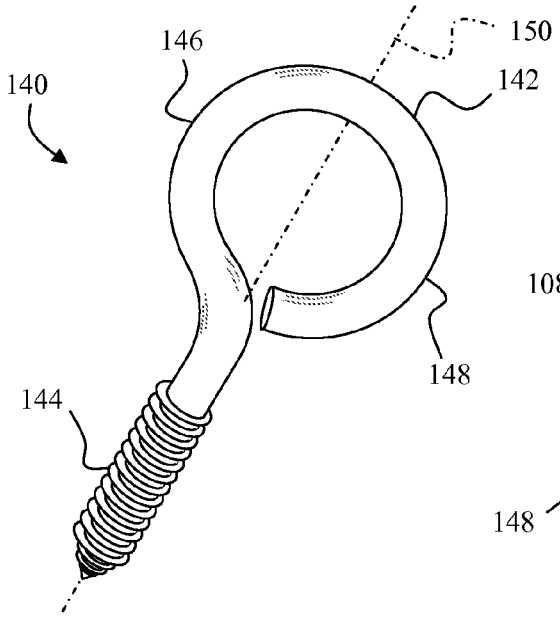
FIG. 6 depicts a perspective view of a fastener type that may be driven with the socket of FIG. 1.

The shape of the cradle 122 provides a driving surface for fasteners such as the fastener 140 of FIG. 6 which includes a round head 142 and a threaded shank 144. The diameter of the round head 142 between opposing portions 146 and 148 define the greatest extent of the fastener 140 from a centerline 150.

Driving a fastener such as the fastener 140 may commence with selection of the desired socket 1 00. Selection of a socket 100 may be based upon identification of a socket amongst a kit of differently sized sockets which most closely reflects the shape of the round head 142. An exact match is not needed. By way of example the diameter of the cradle 122 from the bottom of the slot 108 to the bottom of the slot 110 is slightly less than the diameter of the round head 142 between opposing portions 146 and 148 which define the greatest extent of the fastener 140 from a centerline 150. The slots 108 and 110, however, allow the round head 142 to be received into the driving bore 118.

Figure 7:
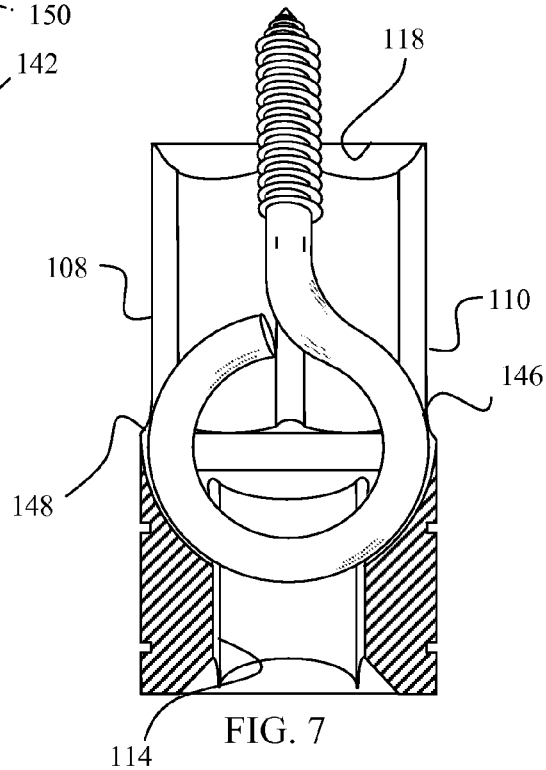
FIG. 7 depicts a cross sectional view of the socket of FIG. 1 with the fastener of FIG. 6 positioned adjacent to the socket cradle.

Accordingly, once the socket 100 has been selected which most closely matches the shape of the round head 142, the round head 142 is aligned with the slots 108 and 110 and the fastener 140 is moved into the driving bore 118 toward the cradle 122. When fully inserted, the round head 142 is positioned close to the portion of the cradle 122 which meets the coupling bore 114 as shown in FIG. 7. The round head 142 may, but need not, rest on the portions of the cradle 122 which meet the coupling bore 114.

Figure 8:
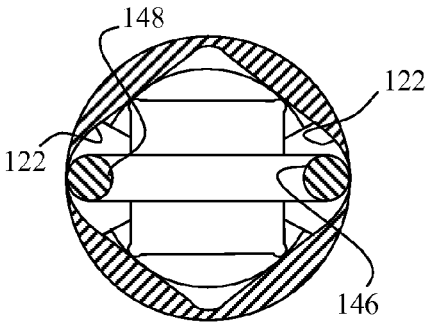
FIG. 8 depicts a cross sectional view of the configuration of FIG. 7.
Figure 9:
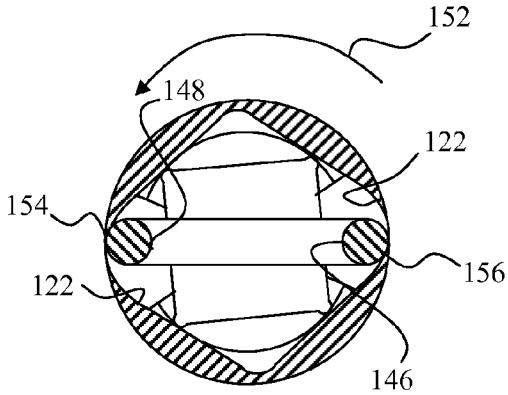
FIG. 9 depicts a cross sectional view of the configuration of FIG. 7 after the socket has rotated the cradle into contact with the fastener at locations close to opposite sides of the fastener head.

The opposing portions 146 and 148 of the round head 142 are located adjacent to the cradle 122 at locations close to the slots 108 and 110 in the arrangement shown in FIGS. 7 and 8. Subsequent rotation of the socket 100 in the direction of the arrow 152 of FIG. 9 rotates the cradle 122 against the opposing portions 146 and 148 of the round head 142, thereby transferring rotational energy form the socket 100 to the fastener 140 at contact areas 154 and 156.

The contact areas 154 and 156 will generally be close to the junction between the cradle 122 and the slots 108 and 110. The exact location and extent of the contact areas 154 and 156 for different combinations of fasteners and sockets will vary depending upon the correlation between the shape of the cradle and the shape of the fastener. Since the cradle 122 extends from the sides of the slots 108 and 110 as well as the bottom of the slots 108 and 110, however, and because the cradle is curved as shown in FIG. 5, the distance between the contact areas 154 and 156 for a given combination of fastener and socket is maximized.

Accordingly, thus, the socket 100 provides an increased mechanical advantage as compared to previous sockets. Additionally, translation of rotational forces into axial forces, that is, forces along the longitudinal axis 124 of the socket 100, are reduced because the cradle 122 contacts the round head 142 at locations closer to the opposing portions 146 and 148.

Figure 10:
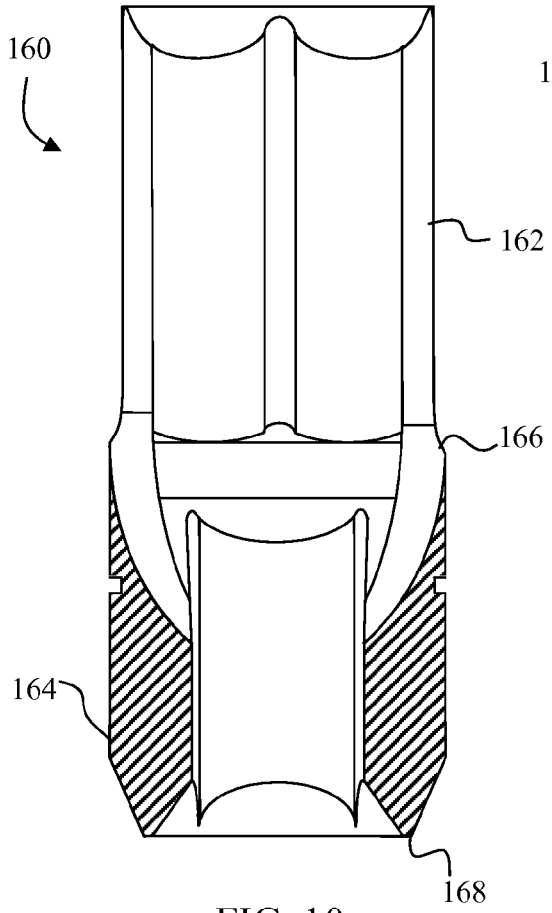
FIG. 10 depicts a cross sectional view of an embodiment of a socket including a plurality of longitudinally extending engagement surfaces and a cradle which are more elongated than the engagement surfaces and cradle of FIG. 1 and with a beveled base portion.

As discussed above, the specific curvature of the cradle may be varied to accommodate fasteners with heads of different curvatures. Additional modification may be made to reduce costs or to enhance capabilities of a socket incorporating a cradle. By way of example, the socket 160 shown in FIG. 10 includes a driving portion 162 and a base 164. The driving portion 162 is extended compared to the driving portion 104 to accommodate fasteners of a height greater than the fasteners driven by the driving portion 104. Additionally, the cradle 166 of the socket 160 is less spherical than the cradle 122 to accommodate differently shaped fasteners. Moreover, the base 164 is beveled at the proximal end portion 168 to reduce cost of materials and weight of the socket.

Figure 11:
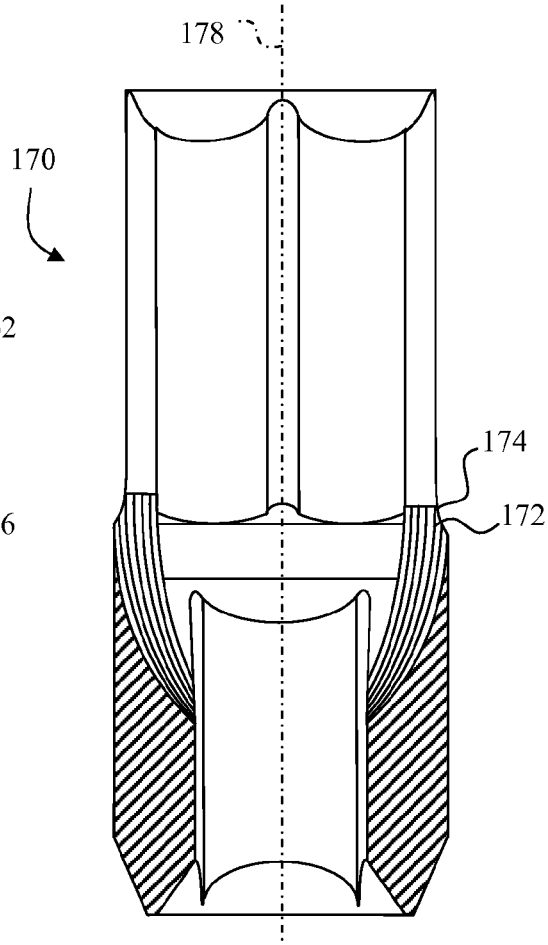
FIG. 11 depicts a cross sectional view of an embodiment of a socket including a plurality of ridges on the cradle which extend along planes within which the longitudinal axis of the socket extends.
Figure 12:
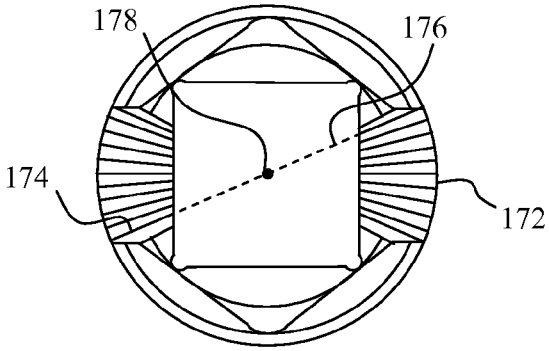
FIG. 12 depicts a top plan view of the socket of FIG. 1.

In a further embodiment, socket 170 shown in FIG. 11 includes ridges 172 on the cradle 174. The ridges 172 extend along a line 176 which passes through the longitudinal axis 178 of the socket 170 when viewed in plan as in FIG. 12. The ridges 172 provide additional structure to reduce the potential of movement between a fastener and the socket 170 as the fastener is driven.

Figure 13:
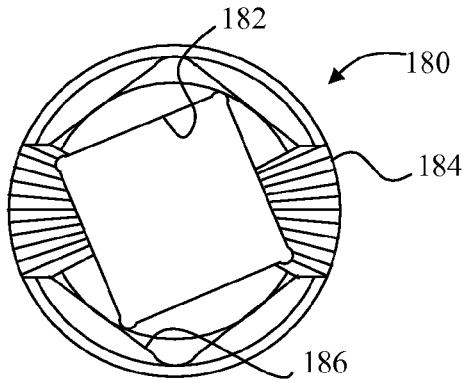
FIG. 13 depicts a top plan view of an embodiment of a socket including a driving bore which is rotated with respect to the cradle and longitudinally extending engagement surfaces as compared with the cradle and longitudinally extending engagement surfaces of the socket of FIG. 12 to modify strength of the socket.

In yet another embodiment, the relationship between various components is modified to provide additional strength. By way of example, the socket 180 of FIG. 13 is identical to the socket 170 with the exception that the driving bore 182 is rotated with respect to the other components of the socket 180 such as the cradle 184 and the lands 186. Orientation of the driving bore 182 may be modified to provide additional strength.

Additionally, the slots 108 and 110 may further be sized to receive fasteners of specific widths. By way of example, fasteners such as the fastener 140 are typically made from a single piece of bent metallic rod. Accordingly, the slots 108 and 110 may be sized to correspond to the diameter of a fastener which closely matches the curvature of the cradle 122. In one embodiment, the socket 100 may be configured such that the lands 120 are configured to drive fasteners and fastener components defining widths which correspond to the shaft widths associated with fasteners received in slots 108 and 110. For instance, the lands 120 in the socket 100 in a kit of sockets may be configured for driving 9/16 inch bolts or nuts while the slots 108 and 110 are sized to receive eyebolts with a 9/16 inch width.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

The invention claimed is:

1. A socket comprising:

a driving portion including an outer surface and a driving bore;

a base portion;

a plurality of lands extending along the driving bore and configured to drive a first type of fastener; and a cradle positioned within the driving bore and defining a driving surface for a second type of fastener, the driving surface curved within a first plane perpendicular to a longitudinal axis of the socket and curved within a second plane in which the longitudinal axis extends.

2. The socket of claim 1, further comprising;

at least one slot in the outer surface of the driving portion, wherein the cradle abuts the slot and curves inwardly from the slot.

3. The socket of claim 2, wherein:

the slot includes a bottom portion and a side portion;

the cradle abuts the bottom portion of the slot;

the cradle abuts the side portion of the slot;

the cradle curves inwardly from the bottom portion of the slot; and the cradle curves inwardly from the side portion of the slot.

4. The socket of claim 1, wherein the driving surface is defined by a portion of an ellipsoid lying within the first plane.

5. The socket of claim 4, wherein the driving surface is defined by a portion of a circle lying within the second plane.

6. The socket of claim 1, wherein the base portion includes a beveled proximal portion.

7. The socket of claim 1, further comprising:

a plurality of ridges extending along the cradle.

8. The socket of claim 7, wherein each of the plurality of ridges extends along a respective one of a plurality of planes in which the longitudinal axis of the socket lays.

9. A socket for driving at least two different types of fasteners, comprising:

a driving portion with an inner surface and an outer surface;

a plurality of driving surfaces extending longitudinally along the inner surface of the driving portion for driving a first type of fastener; and a cradle extending inwardly from the outer surface along a continuously curved line for driving a second type of fastener.

10. The socket of claim 9, wherein the cradle meets the outer surface along a portion of a slot extending from an end portion of the driving portion.

11. The socket of claim 10, wherein the cradle meets the outer surface along a bottom portion of the slot and along a side portion of the slot.

12. The socket of claim 9, wherein:

the cradle extends inwardly from the outer surface along a continuously curved line in a first plane perpendicular to a longitudinal axis of the socket; and the cradle extends inwardly from the outer surface along a continuously curved line in a second plane in which the longitudinal axis extends.

13. The socket of claim 12, wherein the cradle defines a portion of an ellipsoid in the first plane.

14. A socket comprising:

a driving portion including an outer side surface and a driving bore;

a base portion defining a coupling bore, the coupling bore opening to the driving bore;

a first plurality of driving surfaces extending longitudinally within the driving bore opposite to the side surface, each of the first plurality of driving surfaces positioned with respect to each of the other of the first plurality of driving surfaces to drive a first type of fastener; and a second plurality of driving surfaces, each of the second plurality of driving surfaces extending along a continuously curved line from the outer surface of the driving portion to the coupling bore.

15. The socket of claim 14, wherein each of the second plurality of driving surfaces extend along a continuously curved line in a plane perpendicular to the outer side surface.

16. The socket of claim 15, wherein each of the second plurality of driving surfaces extends inwardly from a slot formed in the outer side surface.

17. The socket of claim 16, further comprising a first plurality of ridges extending along a first of the second plurality of driving surfaces.

18. The socket of claim 17, further comprising a second plurality of ridges extending along a second of the second plurality of driving surfaces, each of the second plurality of ridges extending along a plan in which a respective one of the first plurality of ridges extends.

19. The socket of claim 14, wherein each of the second plurality of driving surfaces is formed along an arc with an origin located on a longitudinal axis of the socket.

20. The socket of claim 14, wherein each of the second plurality of driving surfaces curves inwardly from the outer surface in a plane perpendicular to a longitudinal axis of the socket.

* * * * *